US009636532B2

(12) United States Patent
Pena et al.

(10) Patent No.: US 9,636,532 B2
(45) Date of Patent: May 2, 2017

(54) TUNNEL FIRE PROTECTION SYSTEM

(71) Applicant: Tyco Fire Products LP, Lansdale, PA (US)

(72) Inventors: Pedriant Pena, Berkley, MA (US); Jose L. Almeida, Warwick, RI (US); George B. Coletta, West Warwick, RI (US); Luke S. Connery, Rehoboth, MA (US)

(73) Assignee: Tyco Fire Products LP, Lansdale, PA (US)

( * ) Notice: Subject to any disclaimer, the term of this patent is extended or adjusted under 35 U.S.C. 154(b) by 0 days.

(21) Appl. No.: 14/895,881

(22) PCT Filed: Jun. 16, 2014

(86) PCT No.: PCT/US2014/042473

§ 371 (c)(1),
(2) Date: Dec. 3, 2015

(87) PCT Pub. No.: WO2014/201453

PCT Pub. Date: Dec. 18, 2014

(65) Prior Publication Data

US 2016/0121149 A1 May 5, 2016

Related U.S. Application Data

(60) Provisional application No. 61/835,248, filed on Jun. 14, 2013.

(51) Int. Cl.
*A62C 35/68* (2006.01)
*A62C 3/02* (2006.01)
(Continued)

(52) U.S. Cl.
CPC ..... *A62C 35/68* (2013.01); *A62C 3/00* (2013.01); *A62C 3/0221* (2013.01); *B05B 1/265* (2013.01)

(58) Field of Classification Search
CPC ..... A62C 35/58; A62C 35/60; A62C 35/62; A62C 35/64; A62C 35/68; A62C 37/08;
(Continued)

(56) References Cited

U.S. PATENT DOCUMENTS 5,409,066 A 4/1995 McHugh
6,158,519 A * 12/2000 Kretschmer ..... A62C 35/645 169/16

(Continued)

FOREIGN PATENT DOCUMENTS

WO WO2007/118499 10/2007
WO WO 2013/106244 7/2013

OTHER PUBLICATIONS

International Search Report and Written Opinion, PCT/US2014/042473, dated Oct. 14, 2014.

(Continued)

*Primary Examiner* — Christopher Kim
(74) *Attorney, Agent, or Firm* — Perkins Coie LLP

(57) ABSTRACT

A deluge fire protection system for tunnels having vehicle traffic including a main water supply pipe and a horizontal spray nozzle arrangement. The horizontal spray nozzle arrangement includes a nozzle device having an inlet portion defining an internal diameter and an external nominal diameter. The horizontal spray arrangement includes a coupling arrangement between the main water supply and the nozzle device. The coupling arrangement defines a multi-direction flow path between the main water supply and the nozzle device. The multi-direction flow path has an effective length of at least eight times a diameter of the inlet portion, and a cross-sectional area along the effective length greater than the cross-sectional area defined by a diameter of the inlet portion of the body of the nozzle device. The coupling arrangement provides for water delivery to the nozzle device
(Continued)

at a working pressure ranging from about 10 psi. to about 30 psi.

31 Claims, 10 Drawing Sheets

(51) Int. Cl.
*A62C 3/00* (2006.01)
*B05B 1/26* (2006.01)

(58) Field of Classification Search
CPC A62C 37/10; A62C 37/11; A62C 3/00; A62C 3/02; A62C 3/0221; B05B 1/26; B05B 1/262; B05B 1/265
USPC ... 169/16, 17, 18, 56, 57, 64, 70, 37, 40, 41
See application file for complete search history.

(56) References Cited

U.S. PATENT DOCUMENTS

| | | | |
|---|---|---|---|
| 9,089,729 | B2 | 7/2015 | Almeida et al. |
| 2012/0090700 | A1 | 4/2012 | Multer et al. |

OTHER PUBLICATIONS

U.S. Appl. No. 61/835,248, filed Jun. 14, 2013.
European Patent Application No. 14736240.4, filed Jun. 16, 2014, 221 pages; Aug. 22, 2016.

* cited by examiner

TUNNEL FIRE PROTECTION SYSTEM

PRIORITY DATA & INCORPORATED BY REFERENCE

This application is a 35 U.S.C. §371 application of International Application No. PCT/US2014/042473 filed Jun. 16, 2014, which claims the benefit of U.S. Provisional Patent Application No. 61/835,248, filed Jun. 14, 2013, each of which is incorporated by reference in its entirety.

TECHNICAL FIELD

The present invention relates generally to vehicle transit fire protection systems, and more specifically, fire protection systems for tunnels having vehicle traffic.

BACKGROUND ART

Known fire protection systems for road tunnels include fixed firefighting systems that deliver water or other firefighting agent to address a vehicle fire such as, for example, a wheel well fire, a passenger compartment fire, multiple vehicle fires, tractor trailer fires, or fires involving flammable liquid spills or pallets. Water-based fixed firefighting systems can include deluge systems that employ water spray or water mist devices that are always open to deliver the water or water mist at a desired rate or flow (volume per unit of time) and at a desired density or application rate (flow per unit of area). Delivery of water to the sprinklers or nozzles is controlled by one or more fluid control valves, such as for example, deluge valves. The water delivery, control and application can be designed with the objective of protecting occupants in their vehicles, protecting occupants during escape on foot, and managing products of combustion.

The tunnel and the areas to be protected by the fire protection system generally include the roadway, the roof and/or ceiling above the roadway, and the sidewalls which extend from the roof to the roadway. For large tunnels, it can be desirable to divide the area of protection into zones, in which the response and delivery of water to the zones can be individually controlled. The size of the individual zones to be protected is defined by the available water supply and resulting hydraulics, e.g., flow, density and operating pressure requirements of the system and its water distribution devices. The ability of the system to apply water at a designed density within a given zone is a function of the number of devices in the zone, the coverage area of the individual devices, and the spacing and orientation of the devices relative to the protection area and any obstructions or system components within the zone. Generally, the coverage area of the individual device is a function of the geometric area covered by the spray or mist, the operating pressure of the device and its discharge characteristics. Spacing, installation and orientation of the water discharge devices is defined by the piping and fittings interconnecting the devices to one another and the water supply. The number of devices and the amount of piping employed can impact the overall cost of the system. Accordingly, it is desirable to minimize or optimize the number of devices and/or the amount of piping and fittings to meet the design objectives of the system. Although prior system designs hypothesize minimized supply piping, such designs do not detail the coupling arrangements between the device and the supply piping to provide the designed density and protection over a specified zone.

DISCLOSURE OF THE INVENTION

In one preferred embodiment of a fire protection system, a deluge fire protection system is provided for protection of an area having a surface for vehicular transit. The deluge fire protection system includes a main water supply pipe disposed a first distance from the surface and a horizontal spray nozzle arrangement disposed a second distance from the surface with the second distance being less than the first distance. The horizontal spray nozzle arrangement preferably includes a nozzle device having a deflector and a frame supporting the deflector and a coupling arrangement between the main water supply and the nozzle device. The frame has a body defining an orifice and a nozzle axis, the body has an inlet portion defining an inlet internal diameter and a preferably nominal external diameter. The coupling arrangement preferably defines a multi-flow path and preferably at least a two-direction flow path between the main water supply and the nozzle device. The two-direction flow path has an effective length of at least eight times a diameter of the inlet portion of the body of the nozzle device and a cross-sectional area along the coupling arrangement greater than the cross-sectional area defined by a diameter of the inlet portion. Preferably, the two-direction flow path has an effective length of at least eight times the internal diameter of the inlet portion of the body of the nozzle device and a cross-sectional area along the coupling arrangement greater than the cross-sectional area defined by the internal diameter of the inlet portion. Alternatively, the two-direction flow path preferably has an effective length of at least eight times the nominal external diameter of the inlet portion of the body of the nozzle device and a cross-sectional area along the coupling arrangement greater than the cross-sectional area defined by the nominal external diameter of the inlet portion. The nominal external diameter can be defined by an external thread, external groove or other external surface configuration of the inlet portion of the body of the frame of the nozzle device.

In another embodiment of a deluge fire protection system for an area having a surface for vehicular transit, the system includes a main water supply pipe and a horizontal spray nozzle arrangement. The preferred horizontal spray nozzle arrangement includes a nozzle device and a coupling arrangement between the main water supply and the nozzle device. The preferred nozzle device has a deflector and a frame supporting the deflector. The frame has a body defining an orifice and a nozzle axis; and includes an inlet fitting with an external thread of a nominal diameter. The coupling arrangement between the main water supply and the nozzle device preferably delivers water to the inlet fitting at a preferred working pressure ranging from about 10 psi. to about 30 psi.

BRIEF DESCRIPTION OF DRAWINGS

The accompanying drawings, which are incorporated herein and constitute part of this specification, illustrate exemplary embodiments of the invention, and together, with the general description given above and the detailed description given below, serve to explain the features of the preferred embodiments of the invention. It should be understood that the preferred embodiments are some examples of the invention as provided by the appended claims.

MODE(S) FOR CARRYING OUT THE INVENTION

Figure 1A:
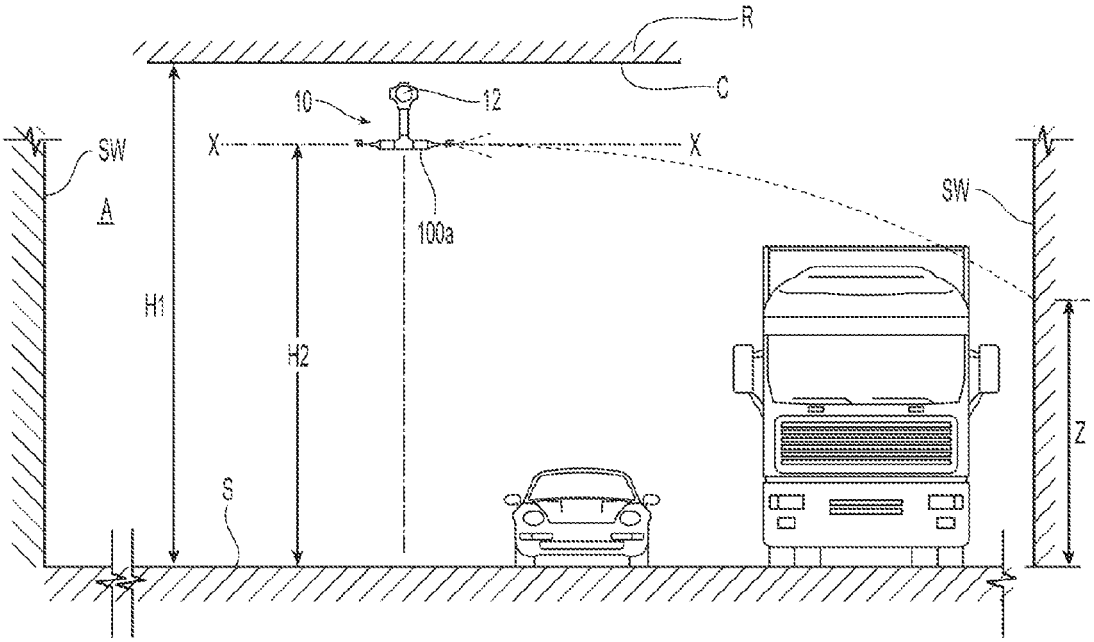
FIG. 1A is a partial elevation view schematic of a preferred fire protection system.
Figure 1B:
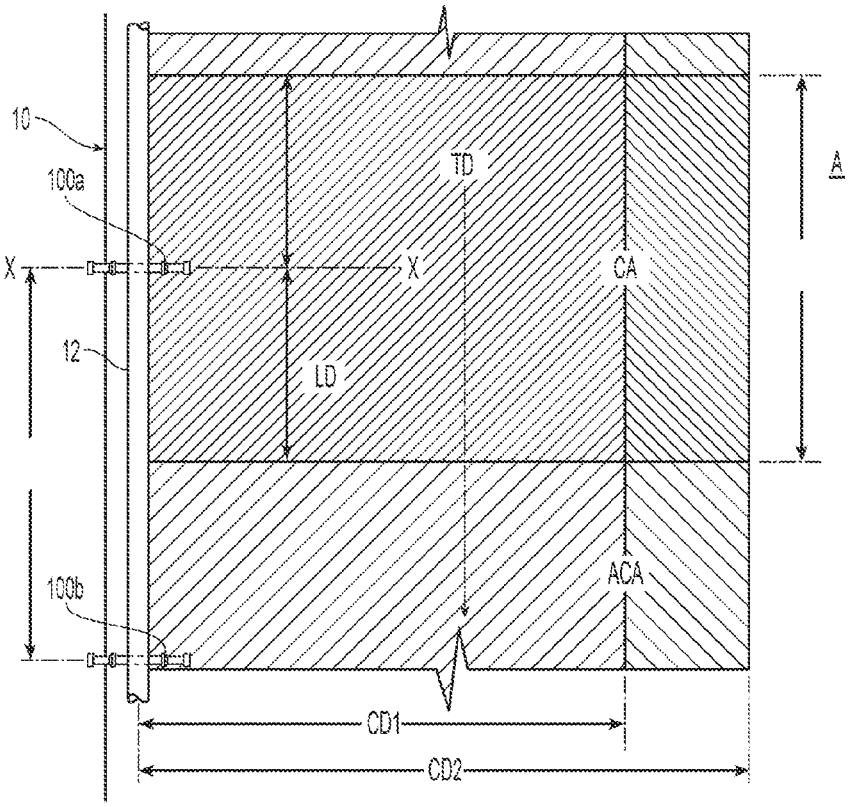
FIG. 1B is a partial plan view schematic of the system of FIG. 1A.

Shown in FIGS. 1A and 1B are respective schematic elevation and plan partial views of a preferred fire protection system for protection of a vehicle transit area A. More specifically, shown is a portion of a vehicle tunnel fire protection system 10 for the transit area A. Generally, the fire protection system 10 includes a main water supply pipe 12 suspended above a vehicle transit surface S of the transit area A, e.g., public or private access roadway, which defines one or more vehicle directions of travel TD. The main water supply pipe 12 is preferably suspended beneath a roof R of the transit area A and is more preferably suspended from the ceiling C of the roof R. The system 10 preferably defines a first ceiling-to-surface distance H1.

The system 10 includes one or more horizontal spray nozzle arrangements 100 coupled to the main supply pipe and suspended above the surface S of the transit area A at a second nozzle arrangement-to-surface distance H2. The distance H2 is preferably a minimum of about 18 feet. As described in greater detail below, the horizontal spray nozzle arrangement 100 includes a nozzle frame, including an inlet portion, and a deflector defining a nozzle axis X-X which preferably extends parallel to the surface S. Each horizontal spray nozzle arrangement 100 and its deflector distribute firefighting fluid, i.e., water to define a protection coverage area CA over which water is distributed by the deflector. The coverage area CA of the nozzle arrangement 100 is defined by a first coverage distance CD in the direction of the nozzle axis X-X and a second coverage distance LD which extends orthogonally from the nozzle axis. The cover area CA is preferably defined by (2×LD)×CD. When the system 10 includes two or more horizontal nozzle arrangements adjacent one another, the nozzle arrangements 100*a*, 100*b* define a coverage area CA and an adjacent coverage area ACA.

Figure 2A:
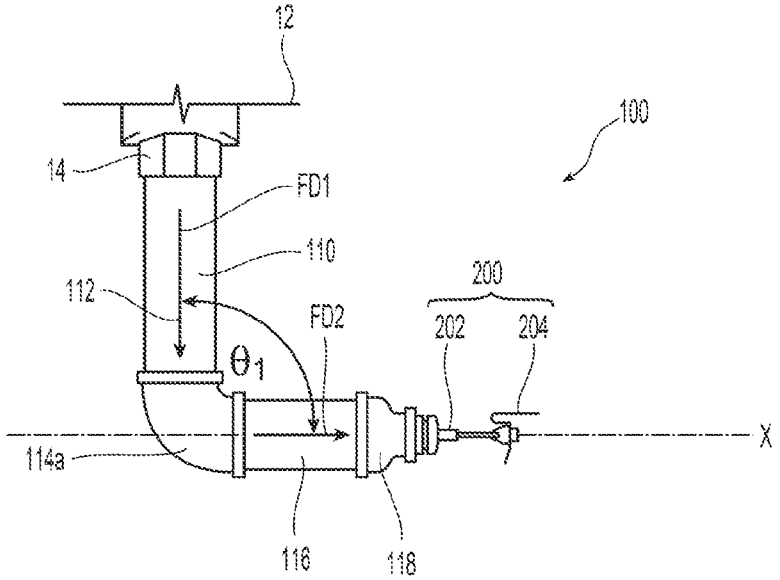
FIG. 2A is one embodiment of a horizontal spray nozzle arrangement for use in the system of FIG. 1A.
Figure 2B:
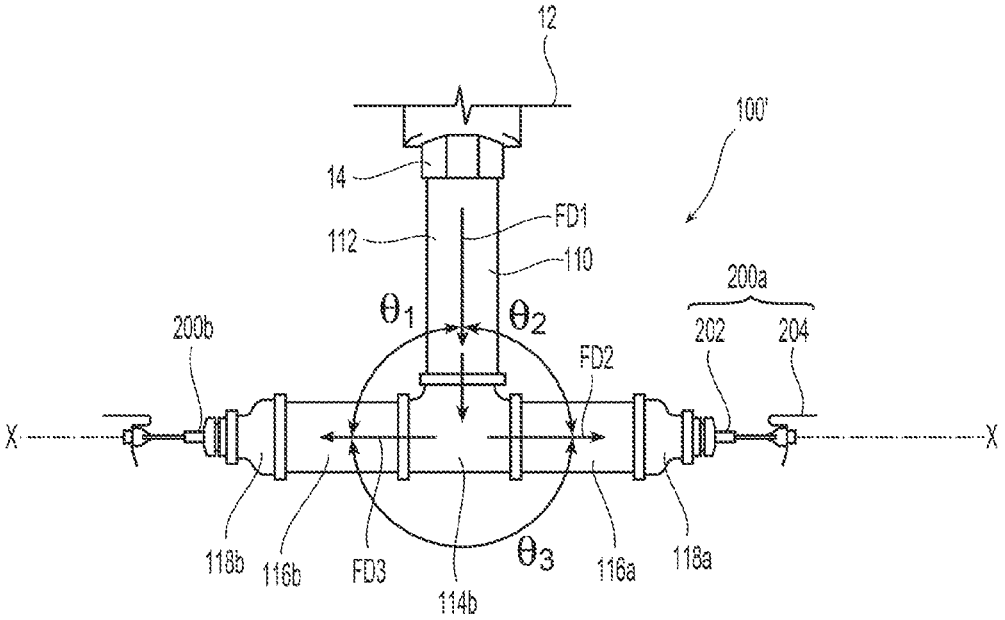
FIG. 2B is another embodiment of a horizontal spray nozzle arrangement for use in the system of FIG. 1A.

Shown in FIGS. 2A and 2B are preferred embodiments of a horizontal spray nozzle arrangement 100, 100' for use in the system 10. The horizontal spray nozzle arrangement 100 is coupled to and preferably extends from the outlet 14 formed in the main supply pipe 12. Each horizontal nozzle spray arrangement 100 includes one or more nozzle devices 200 and a coupling arrangement 110 for coupling the nozzle device(s) 200 to the main water supply pipe 12. The preferred coupling arrangement 110 preferably defines multiple flow paths and more preferably defines at least a two-direction flow path between the main water supply 12 and the nozzle device 200 and its frame 202. With reference to FIG. 2A, the coupling arrangement 110 defines a first flow direction FD1 and at least a second flow direction FD2 to define the complete flow path from the main water supply pipe 12 to the nozzle device 200. The first and second flow direction paths FD1, FD2 are preferably skewed or angled with respect to one another and more preferably orthogonal with respect to one another to define an included angle θ1 between the first and second flow directions FD1, FD2. In one preferred aspect, the multi-flow direction flow path aligns the horizontal nozzle axis X-X substantially parallel to the surface S. Additionally, the preferred coupling arrangement defines an effective length and cross-sectional area to further define the flow of fluid to the nozzle 200 and provide a desired spray pattern for the protection of the area A. As used herein, the effective length of a coupling arrangement, pipe fitting or pipe assembly having a pipe fitting(s), is defined as the equivalent pipe length of a straight pipe when accounting for head loss due to the fitting(s) in the arrangement. The effective cross-sectional area of a coupling arrangement, pipe fitting or pipe assembly having a pipe fitting(s) is defined as the area of a plane defined by the width and more preferably a diameter of the interior surface of the arrangement disposed normal to the direction of flow through the arrangement.

The preferred coupling arrangement 110 includes a drop nipple 112 and a pipe fitting 114*a* coupled to the drop nipple 112. The drop nipple 112 preferably extends from the outlet 14 of the main water supply pipe 12 vertically and more preferably toward the surface S to define the first direction FD1 of the two-direction flow path. The outlet 14 defines a preferred nominal diameter of 2 inches. The drop nipple 112 preferably defines a nominal diameter of 2 inches and a nominal length ranging from 8 inches to 9 inches. The pipe fitting 114*a* extends from the drop nipple 112 to the nozzle device 200 to define the second direction FD2 of the two-direction flow path. The second direction FD2 preferably extends perpendicularly to the first direction FD1.

In one preferred embodiment of the coupling arrangement 110, shown in FIG. 2A, the pipe fitting 114*a* preferably includes an elbow fitting 114*a* and a reduction assembly. The preferred elbow fitting 114*a* is preferably a ninety degree (90°), 2 in.×2 in. elbow fitting 114*a*. The elbow fitting 114*a* preferably defines an effective length of 8.5 feet. Preferably disposed between the elbow fitting 114*a* and the preferably horizontally disposed nozzle device 200 is a reduction assembly to define a preferred cross-sectional area along the coupling arrangement 110 that is greater than the cross-sectional area defined by the inlet portion of the nozzle device 200. In one preferred embodiment, the cross-sectional area ranges from about 1.25 square inches to about 4.5 square inches. A preferred reduction assembly includes a second nipple and more preferably an arm-over nipple 116 having a preferably nominal two inch diameter and a pipe reducing fitting 118 and more preferably a 2 in.×1 in. reducing fitting. The preferred reduction assembly defines a cross-sectional area of about 1.25 square inches and is more preferably 1.36 square inches between the elbow fitting 114*a* and the nozzle device 200.

Shown in FIG. 2B is another preferred embodiment of the horizontal spray nozzle arrangement 100' having a coupling arrangement 110 defining multi-directional flow paths skewed or angled with respect to one another between the main water supply pipe 12 and the nozzle device 200. As shown, the coupling arrangement 110 preferably defines three flow paths FD1, FD2, FD3 in which at least two flow paths are skewed with respect to one another. In the preferred embodiment of FIG. 2B, the second and third flow paths FD2, FD3 are orthogonal to the first flow path FD1 and axially aligned with one another. The flow paths FD1, FD2, FD3 define included angles θ1, θ2, θ3 between one another in which at least one of the included angles defines an angle of less than 180 degrees (180°). For the preferred embodiment of FIG. 2B, the first included angle θ1 between the first flow path FD1 and FD2 is about ninety degrees (90°), the second angle θ2 between the first flow path FD1 and FD3 is about ninety degrees (90°), and the third angle θ3 between the first flow path FD2 and FD3 is about 180 degrees (180°). The coupling arrangement 110 can be alternatively configured such that each of the flow paths is skewed or angled with respect to the other flow paths.

The horizontal spray nozzle arrangement 100' preferably includes a drop nipple 112 and a pipe fitting 114*b* coupled to the drop nipple 112. The drop nipple 112 preferably extends from the outlet 14 of the main water supply pipe 12 vertically and more preferably toward the surface S to define the first direction FD1 of the multi-direction flow path. The drop nipple 112 preferably defines a nominal diameter of 2 inches and a nominal length ranging from 8 inches to 9 inches. The pipe fitting 114*b* preferably includes a tee fitting 114*b* and a pair of reduction assemblies which extends from the drop nipple 112 to each of a first nozzle device 200*a* and a second nozzle device 200*b* to respectively define the second direction FD2 and third direction FD3 of the multi-direction flow path of the coupling arrangement 110. The first and second nozzle devices 200*a*, 200*b* are disposed in preferred back-to-back relation with respect to one another. The preferred tee fitting is preferably a 2 in.×2 in.×2 in. tee fitting 114*b*. The tee fitting 114*b* preferably defines an equivalent length of twelve feet (12 ft.). Preferably respectively disposed between each of the tee fitting 114*b* and the preferably horizontally disposed first and second nozzle devices 200*a*, 200*b* are a preferred first and second reduction assembly each including a nipple and reducer arrangement and in particular, an arm-over nipple 116*a*, 116*b* having a preferably nominal two inch diameter and a pipe reducing fitting 118*a*, 118*b* and more preferably a 2 in.×1 in. reducing fitting. The reduction fittings preferably define an effective cross-sectional area of about 4.5 square inches and more preferably a cross-sectional area of 4.45 square inches between the tee fitting and the nozzle device 200*a*, 200*b*.

The 90-degree elbow 114*a* and tee-fitting 114*b* of the preferred coupling arrangements orient the first and at least the second flow paths FD1, FD2 orthogonal to one another. Alternatively, the pipe fitting 114 can be embodied as a 120 degree (120°) elbow or three-way fitting to skew the flow paths accordingly with respect to one another. Moreover, the coupling arrangement 110 can include more than one pipe fitting 114 and an appropriate number of corresponding nipples provided the resulting coupling arrangement 110 locates and orients the nozzle device 200 and delivers the working fluid pressure to the nozzle device 200 in a manner suitable for protection of the area A. Preferably, the resulting coupling arrangement defines an effective pipe length and cross-sectional area as described above. The cross-sectional area(s) defined by the coupling arrangement 110 may be variable over one or more portions of the length of the coupling arrangement including having a cross-sections smaller than that defined by the inlet portion 208 of the nozzle device 200. Alternatively, the cross-section can be constant over the entire length of the coupling arrangement provided a sufficient flow of fluid is provided to the nozzle device for protection of the area A as described herein. Alternatively or in addition to, the coupling arrangement 110 can define an internal reservoir or expansion in the fluid flow path to hold, slow down or circulate fluid and provide fluid flow characteristics to the nozzle device to provide the desired spray pattern for protection of the area A. For example, the coupling arrangement 110 can include an elbow or tee-fitting 114 with an expanded volume relative to the drop nipple 112 or reduction assembly to define an internal volume to collect and provide a fluid reservoir to supply the nozzle device(s) 200.

Figure 3:
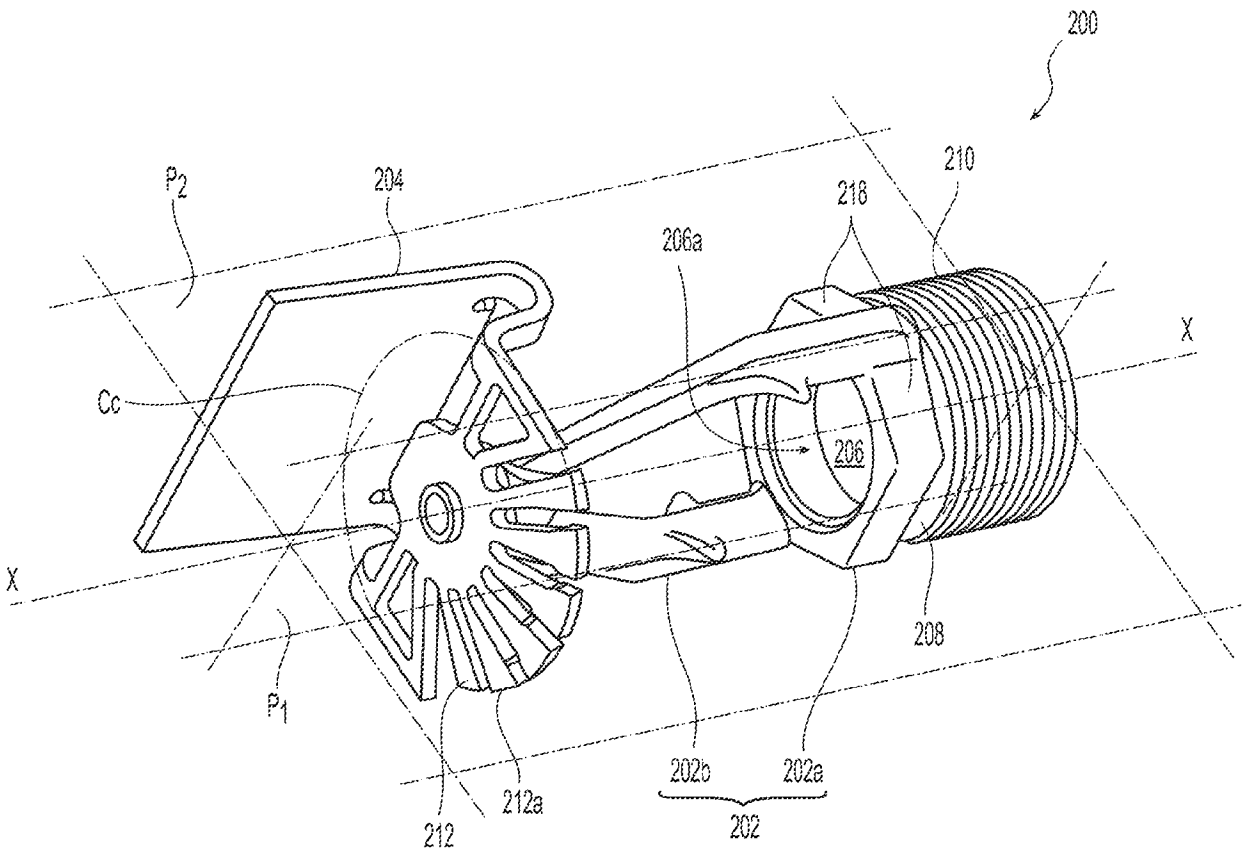
FIGS. 3, 3A, and 3B are various views of a preferred nozzle device for use in the arrangements of FIGS. 2A and 2B.
Figure 3A:
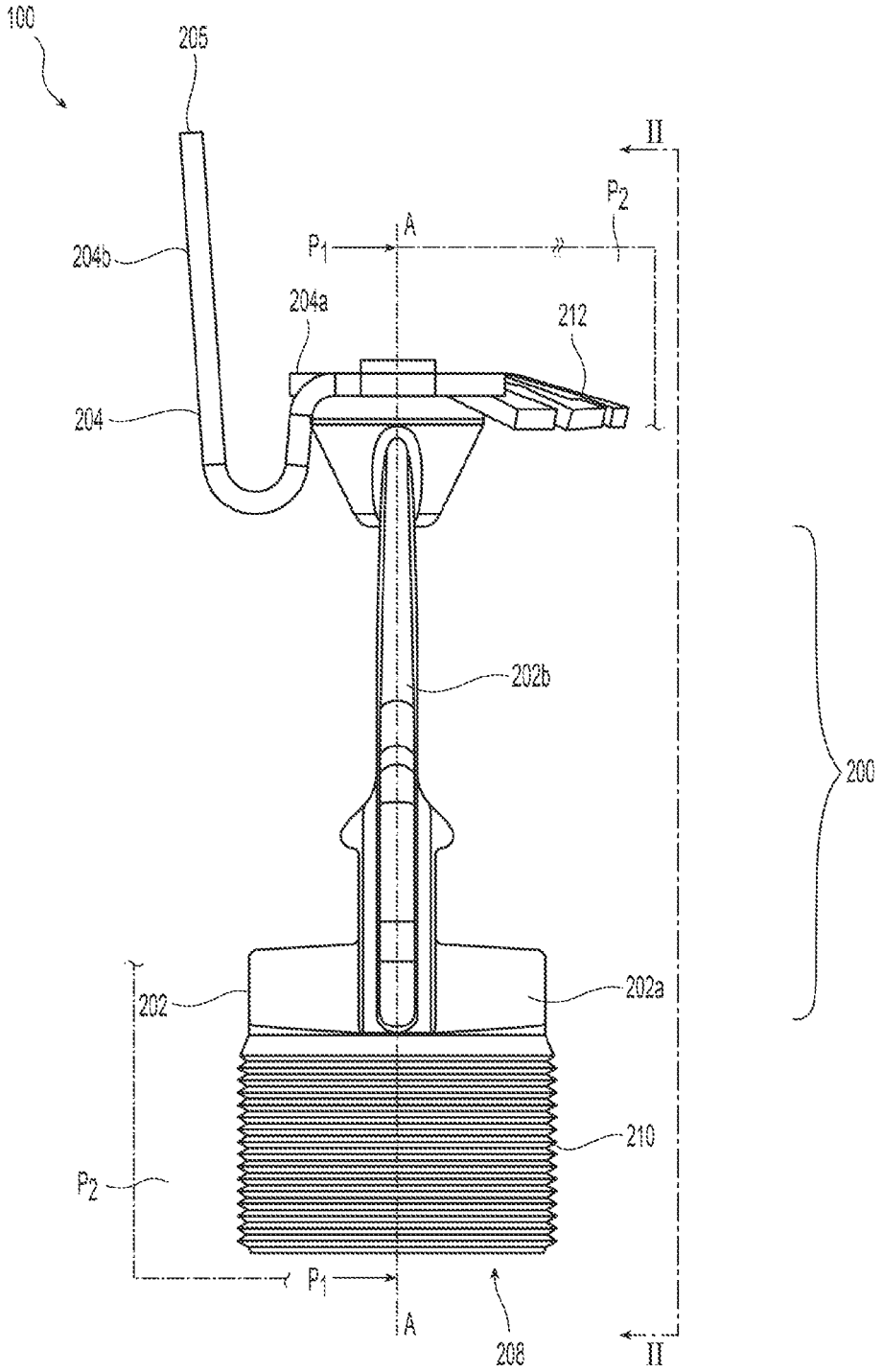
Figure 3B:
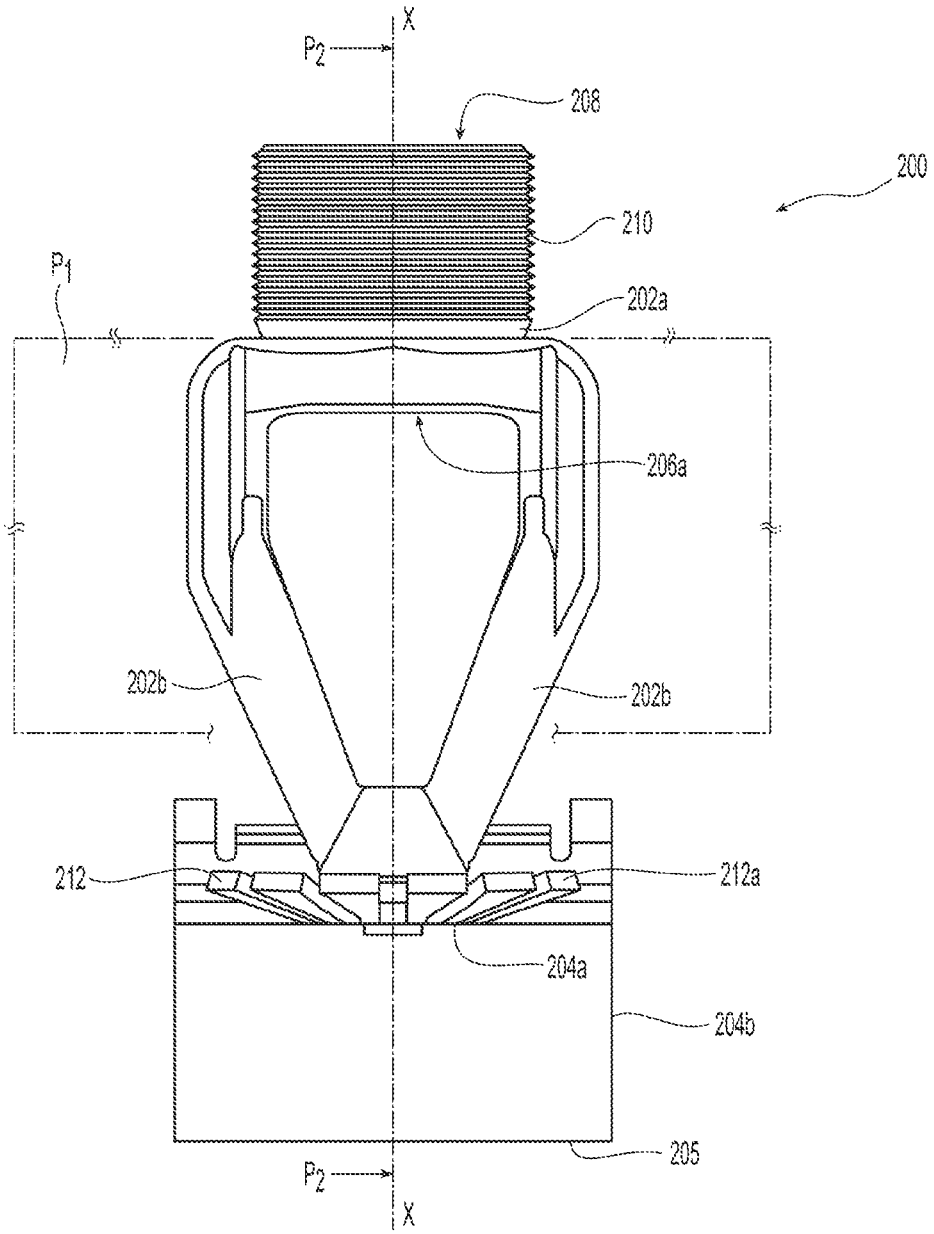

The preferred nozzle device 200 includes a frame 202 and a deflector 204 supported from the frame 202. Shown in FIGS. 3, 3A and 3B is a preferred embodiment of the nozzle device 200. The preferred frame 202 includes a body 202*a* having an internal surface that defines an internal passageway 206 extending along the nozzle axis X-X and an outlet or orifice 206*a* of the body 202*a*. The internal passageway 206 and orifice 206*a* define a K-factor of the nozzle device 200 of 8.0 GPM/$(PSI)^{1/2}$ or greater, and more preferably, a nominal K-factor of 25.2 GPM/$(PSI)^{1/2}$. As used herein, the nominal K-factor is defined as a constant representing the sprinkler discharge coefficient that is quantified by the flow of fluid in gallons per minute (GPM) from the sprinkler outlet divided by the square root of the pressure of the flow of fluid fed into the inlet of the sprinkler passageway in pounds per square inch (PSI). The nominal K-factor is expressed as GPM/$(PSI)^{1/2}$. Industry accepted standards, such as for example, the National Fire Protection Association (NFPA) standard entitled, "NFPA 13: Standards for the Installation of Sprinkler Systems" (2013 ed.) ("NFPA 13") provide for a rated or nominal K-factor or rated discharge coefficient of a sprinkler as a mean value over a K-factor range. For example, for a K-factor equal to greater than 8.0, the following nominal K-factors are provided (with the K-factor range shown in parenthesis): (i) 8.0 (7.4-8.2) GPM/$(PSI)^{1/2}$; (ii) 11.2 (11.0-11.5) GPM/$(PSI)^{1/2}$; (iii) 14.0 (13.5-14.5) GPM/$(PSI)^{1/2}$; (iv) 16.8 (16.0-17.6) GPM/$(PSI)^{1/2}$; (v) 19.6 (18.6-20.6) GPM/$(PSI)^{1/2}$; (vi) 22.4 (21.3-23.5) GPM/$(PSI)^{1/2}$; (vii) 25.2 (23.9-26.5) GPM/$(PSI)^{1/2}$; and (viii) 28.0 (26.6-29.4) GPM/$(PSI)^{1/2}$.

The body 202*a* and its internal and external surfaces further define an inlet portion or fitting 208 of the frame 202. The inlet portion 208 of the frame 202 is preferably configured for forming a mechanical connection to join the nozzle device 200 to, for example, the coupling arrangement 110. In a preferred embodiment of the body 202*a*, the inlet portion 208 preferably includes an external thread 210. The external thread 210 defines a nominal diameter of the frame 202. The external thread 210 of the preferred nozzle device 200 defines a preferred nominal diameter of one inch NPT or ISO 7-R 1. Alternatively, the inlet portion 208 can include an external groove of a nominal diameter for forming a grooved coupling connection. The inlet portion 208 can be alternatively configured to form the mechanical connection. For example, the internal surface of the inlet 208 can include an internal thread for forming a threaded connection.

As previously described, the preferred coupling arrangement 110 includes a plurality of pipes, nipples and/or fittings to define the two-direction flow path and more preferably define an effective length and cross-section. The preferred effective length of the coupling arrangement 110 is at least eight to ten times a nominal diameter of the inlet fitting 208. For example, the effective length of the coupling arrangement 110 is at least eight to ten times the nominal diameter of the external thread 210 of the body 202*a* of the horizontal spray nozzle device 200; or alternatively, at least eight to ten times the nominal diameter defined by an external groove of the body 202*a*. The preferred effective cross-sectional area of the coupling arrangement, along the effective length, is greater than the cross-sectional area defined by a nominal diameter of the inlet fitting 208. The cross-sectional area of the inlet fitting can be defined by the internal diameter of the inlet portion 208 or may be alternatively defined by the external surface of the inlet portion 208, for example, by the nominal diameter of an external thread, groove or other coupling surface configuration.

The preferred frame 202 preferably includes a pair of frame arms 202*b* to support the deflector 204 from the body 202*a*. The pair of frame arms 202*b* are preferably disposed about the orifice 206*a* to define a plane P1. The nozzle axis X-X is preferably defined by the intersection of the plane P1 and a second plane P2, which is perpendicular to the first plane P1 and symmetrically bisects the device 200. The deflector 204 preferably includes a face plate portion 204*a* disposed orthogonal to the nozzle axis X-X and a canopy portion 204*b* having a leading edge 205. The face plate 204*a* is preferably disposed between the leading edge 205 and the body 202*a*. In addition, the leading edge 205 is preferably radially spaced from the nozzle axis X-X and extends substantially parallel to the first plane P1. The deflector 204 further preferably includes a plurality of tines 212 extending radially from the face plate portion 204*a* and disposed to one side of the first plane P1 opposite the canopy portion 204*b*. Each of the plurality of tines 212 terminates in a peripheral edge 212*a*. The peripheral edges 212*a* are preferably aligned along a perimeter of a common circle Cc centered on the nozzle axis. Additional features of a preferred nozzle device 200 for use in the system 10 is embodied in the nozzle device shown and described in U.S. Provisional Application No. 61/835,248.

Referring again to FIGS. 1A and 1B, the preferred coupling arrangements 110, in addition to coupling the nozzle device 200 to the main water supply pipe 12, locates the nozzle device 200 at a vertical distance H2 above the surface S and orient the nozzle device or devices and its horizontal axis X-X to the main water supply pipe 12. Accordingly, the horizontal axis X-X can be oriented parallel to the linear alignment of the main water supply pipe 12 or alternatively skewed or angled to and more preferably perpendicular to the linear alignment of the main water supply pipe 12. The linear alignment of the main water supply 12 preferably runs parallel to the direction (bi-direction) of traffic flow TD, but may alternatively run perpendicular to the direction of traffic TD.

Figure 4A:
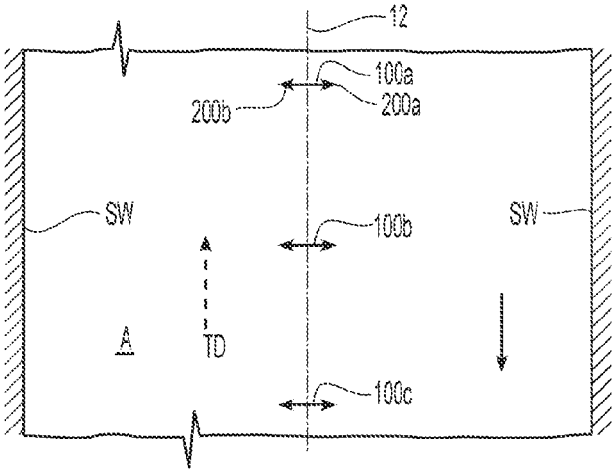
FIGS. 4A-4L are various embodiments of the fire protection system of FIG. 1A with various configurations and combinations of the horizontal spray nozzle arrangements of FIGS. 2A and 2B.
Figure 4B:
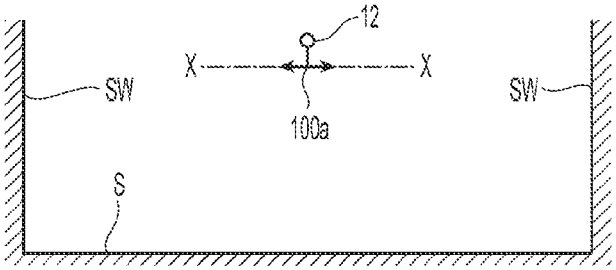
Figure 4C:
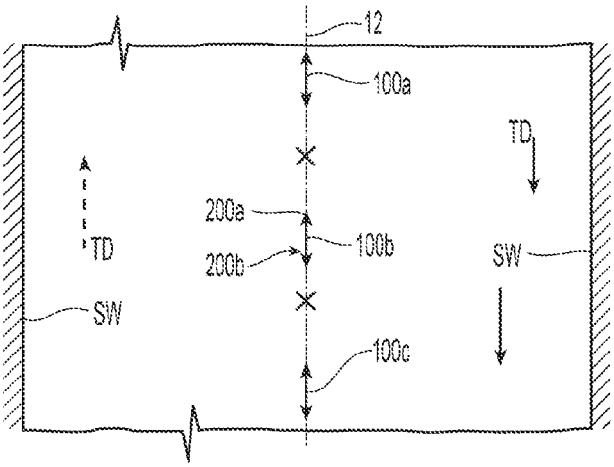
Figure 4D:
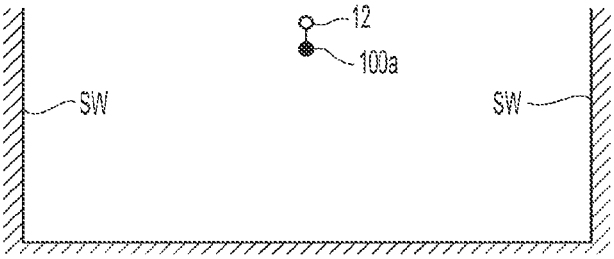
Figure 4E:
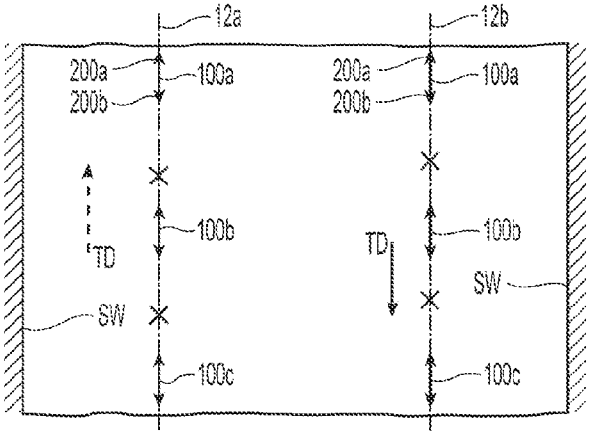
Figure 4F:
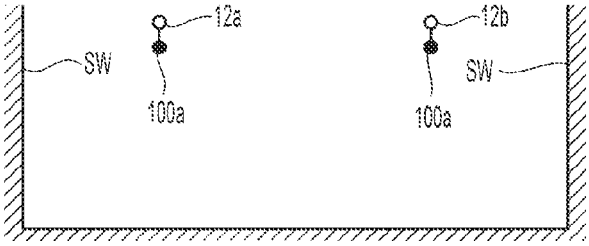
Figure 4G:
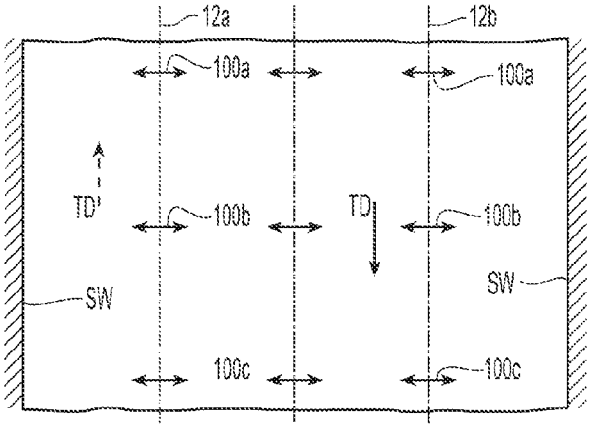
Figure 4H:
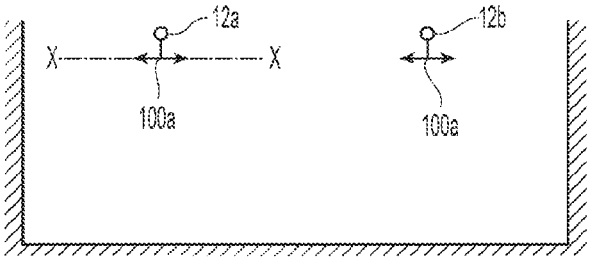
Figure 4I:
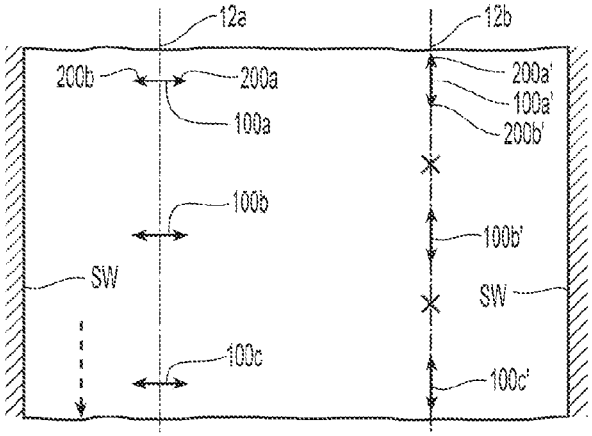

The protection area A is further preferably defined by a pair of sidewalls SW which are spaced apart by the surface S and extend in the direction of the ceiling C. The system 10 includes one and can include more than one main water supply pipe 12 with each main water supply pipe including one or more horizontal spray nozzle arrangements 100 to define a coverage area or zone of protection in the area A. Shown in FIGS. 4A-4L are various embodiments of the fire protection system 10 in which there are one or more main water supply pipes 12 with their horizontal spray nozzle arrangements 100 in varying orientations. More specifically, shown in the respective plan and elevation views of FIGS. 4A and 4B is a single main water supply pipe 12 preferably centered between the sidewalls SW of the protection area A and extending in the direction (bi-direction) TD of traffic flow. The supply pipe 12 includes a plurality of horizontal arrangements 100*a*, 100*b*, 100*c*, each having a first nozzle device 200*a* and a second nozzle device 200*b* in a back-to-back relationship as preferably previously described with respect to FIG. 2B. The horizontal arrangements 100*a*, 100*b*, 100*c* are preferably configured so that the axes X-X of the nozzle devices 200*a*, 200*b* are oriented perpendicular to the main water supply pipe 12. Shown in FIGS. 4C and 4D is an alternate embodiment in which the horizontal arrangements 100*a*, 100*b*, 100*c* are configured with the back-to-back nozzles 200*a*, 200*b* oriented so that their axes X-X are oriented parallel to the main water supply pipe 12.

Shown in FIGS. 4E-4H are alternate embodiments of the system 10 in which there are multiple and more preferably two water main supply pipes 12*a*, 12*b* oriented in the direction (bi-direction) TD of vehicle traffic. The water supply pipes 12*a*, 12*b* are preferably spaced such that the pipes 12*a*, 12*b* are centered between the sidewalls SW. Each of the main water supply pipes 12*a*, 12*b* include a plurality of horizontal spray nozzle arrangements 100*a*, 100*b*, 100*c*, each preferably configured with first and second nozzle device 200*a*, 200*b* in a back-to-back arrangement. For the embodiments shown in FIGS. 4E-4H, the horizontal spray nozzle arrangements 100*a*, 100*b*, 100*c* are configured so that all the nozzle devices 200*a*, 200*b* of each of the main water supply pipes 12 are aligned in a single direction. For example as shown in the plan view of FIG. 4E, all the nozzle devices 200*a*, 200*b* are oriented so that their axes X-X extend parallel to supply pipes 12*a*, 12*b*. Alternatively shown in the plan view of FIG. 4G, the horizontal spray arrangements 100*a*, 100*b*, 100*c* are configured so as to orient the nozzle axes X-X perpendicular to the supply pipes 12*a*, 12*b*.

Figure 4J:
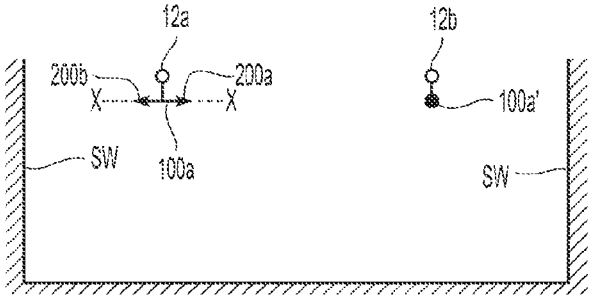

Referring now to the respective plan and elevation views of FIGS. 41 and 4J, an alternate embodiment of the fire protection system 10 is shown having multiple main water supply pipes 12*a*, 12*b* centered between the side walls SW. In this embodiment, the horizontal spray nozzle arrangements 100*a*, 100*b*, 100*c* of supply pipe 12*a*, are configured differently from the spray nozzle arrangements 100*a*', 100*b*', 100*c*' of supply pipe 12*b*. More preferably, the horizontal spray nozzle arrangements 100*a*, 100*b*, 100*c*, of one supply pipe are oriented perpendicular to the main water supply pipe 12*a*; and the spray nozzle arrangements 100*a*', 100*b*', 100*c*' of the main water supply pipe 12*b* are oriented parallel to their supply pipe 12*b*.

Figure 4K:
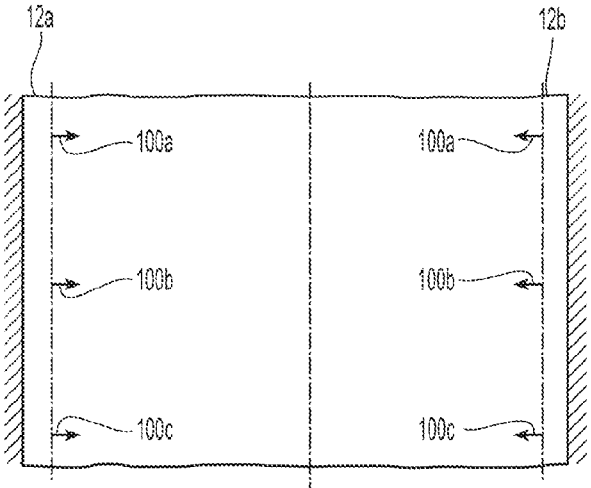
Figure 4L:
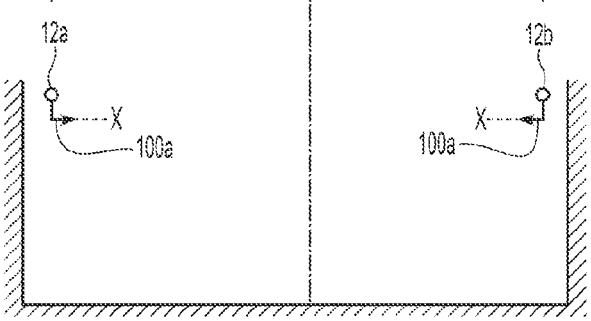

Shown in FIGS. 4K and 4L is yet another embodiment of the system 10. The system includes multiple and more preferably two water supply pipes 12*a*, 12*b* spaced and centered between the sidewalls SW of the protection area A in the direction (bi-direction) TD of traffic flow. Each of the water supply pipes 12*a*, 12*b* includes a plurality of horizontal spray arrangements 100*a*, 100*b*, 100*c*, each preferably configured with a single nozzle device 200 oriented with its nozzle axis X-X perpendicular to the main water supply pipe 12*a*, 12*b*. Accordingly, the coupling arrangement 110 of each horizontal spray nozzle arrangement 100 includes an elbow fitting as shown and described with respect to FIG. 2A. The main water supply pipes 12*a*, 12*b* are preferably located so that the nozzle devices deflect water in a direction toward the center of the protection area A. More preferably, the main water supply pipes 12*a*, 12*b* are disposed closer to one wall with its spray directed in the direction of the oppositely located sidewall and away from the closer wall.

Figure 5A:
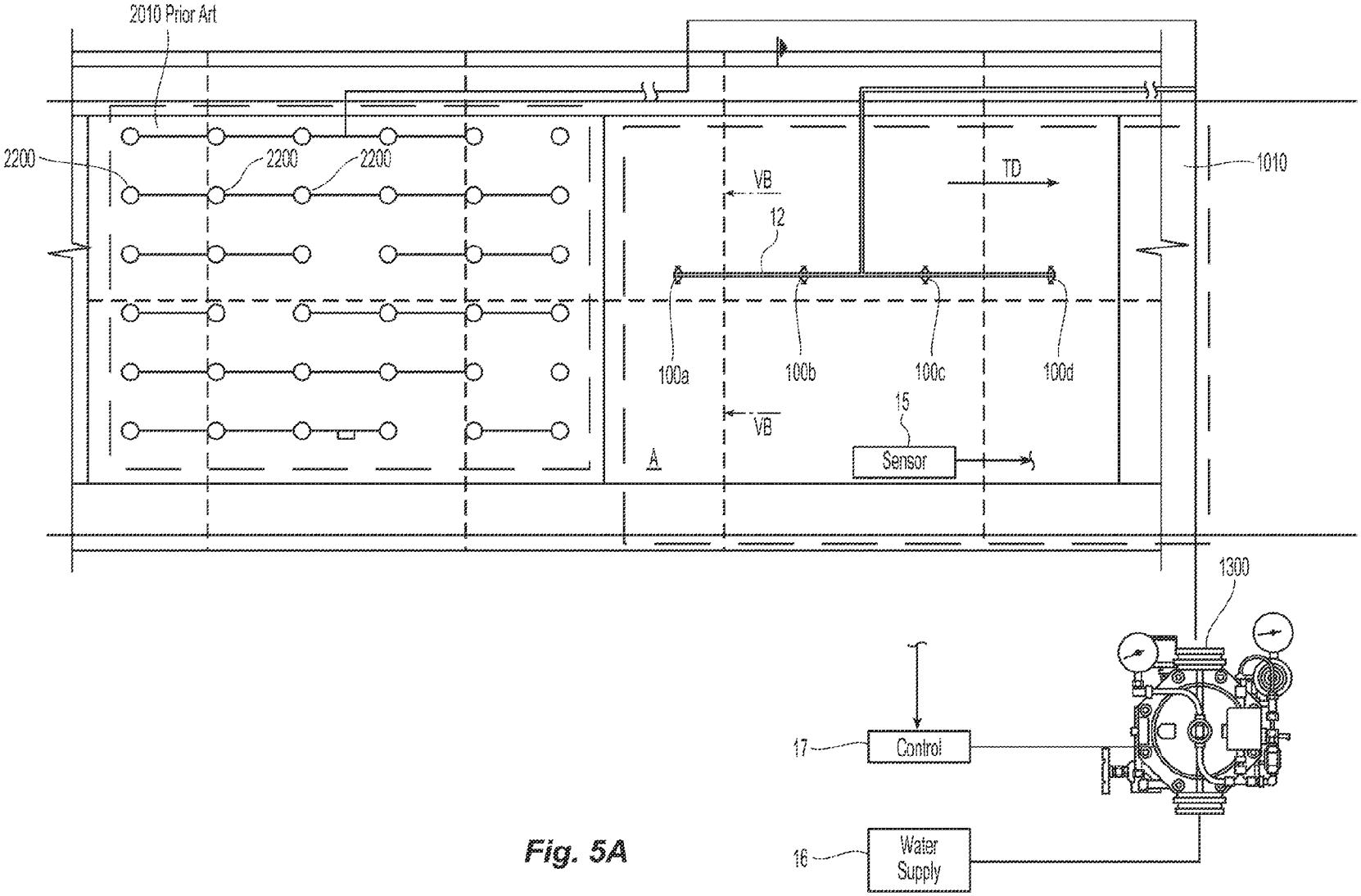
FIG. 5A is a plan view schematic of a preferred deluge fire protection system adjacent a prior art system.

The nozzle devices 200 of the system 10 are preferably always in an open state such that upon water delivery to the nozzle device 200 and its inlet, water is free to discharge from the nozzle outlet 206*a* for distribution by the deflector 204 over the area A to be protected. Accordingly, the system 10 is preferably configured as a deluge fire protection system 10. Fluid or water delivery to the main water supply pipes (P) and horizontal spray nozzle arrangements 100 is preferably controlled by a fluid control valve and more preferably by a deluge fluid control valve 1300 as schematically shown in the deluge fire protection system 1010 in FIG. 5A. A preferred deluge valve for use in the system 1010 is shown and described in U.S. Provisional Application No. 61/835, 428. Actuation and operation of the deluge valve 1300 can be automatic, manual or a combination of both. The system 1010 can include one or more sensors 15 disposed about the protection area A to detect a fire hazard for actuation of the valve 1300. The sensors 15 are preferably coupled to the control 17 which actuates and controls the valve 1300. The sensors 15 can be any one of spot heat detectors; linear heat detectors; passive smoke detectors; active smoke (aspirating) detectors; optical sensors (IR, UV, UV/IR) and/or closed-circuit television (CCTV).

Figure 5B:
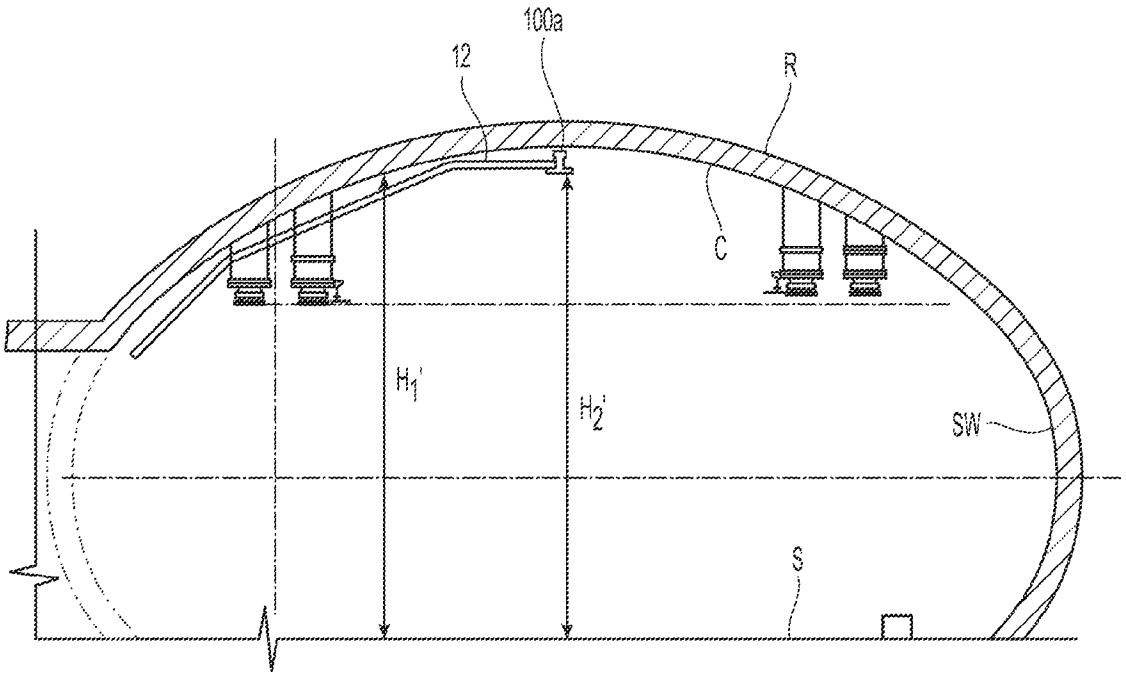
FIG. 5B is an elevation view of the system of FIG. 5A along line VB-VB.

The deluge fire protection system 10 is hydraulically designed such that water distribution from the nozzle device defines the desired coverage area CA, as shown in FIG. 1B, with a desired distribution density. In one embodiment of the system 10, each nozzle device 200 distributes water at a preferred density (volumetric flow rate per area) of about 0.25 gallons per minute per square foot (GPM/SQ. FT). As previously described, the coverage area is preferably defined by the water distribution throw distance CD in the direction of the nozzle axis X-X and its lateral distribution distance LD in the direction perpendicular to the nozzle axis X-X. The coverage is preferably a function of the operating pressure range of the nozzle and its discharge coefficient or nominal K-factor as previously described. For the preferred nozzle device of FIG. 3, the K-factor is a nominal 25.2 and the preferred working pressure ranges from a minimum pressure of about 10 psi. to a maximum pressure of about 30 psi. The working pressure may be lower than 10 psi. or higher than 30 psi. provided the delivered to the nozzle device 200 provides for a suitable spray pattern in the protection area A as described. As used herein, the term "about" is understood as within a range of normal tolerance in the art, for example within 2 standard deviations of the mean. "About" can be understood as within 10%, 9%, 8%, 7%, 6%, 5%, 4%, 3%, 2%, 1%, 0.5%, 0.1%, 0.05%, or 0.01% of the stated value. Unless otherwise clear from context, all numerical values provided herein are modified by the term about. Referring again to FIG. 1B, the working pressure range preferably defines the range of the throw distance CD of the preferred nozzle 200 which preferably ranges from a minimum CD1 of about 20 feet and more preferably 19 feet-seven inches to a maximum CD2 of about 25 feet and more preferably 24 feet-seven inches. Over the entire preferred working pressure range, the preferred nozzle device 200 distributes water laterally to one side of the axis a lateral distance LD of about 8 feet and more preferably 8 feet-2 inches or a total of 16 feet about the nozzle axis X-X. The preferred spacing between adjacent nozzle devices 200 maximizes the coverage of each nozzle device, and therefore the preferred spacing is preferably twice the lateral distance LD of adjacent nozzles. For the preferred nozzle, a preferred spacing between adjacent nozzles is about sixteen feet (16 ft.). As shown in FIG. 1A and depending upon the location and orientation of the horizontal spray arrangement nozzle device 200 relative to the sidewalls SW, the water distribution can define a maximum vertical height Z on the sidewall SW to which the distributed water will reach. In one preferred embodiment, the water distribution from the nozzle 200 defines a maximum vertical height Z of about 4.5 meters. The sidewalls SW and the ceiling C are schematically shown in FIG. 1A as being planar and orthogonal to one another. However, it should be understood that either or both of the sidewalls SW and roof can be non-planar as seen for example in FIG. 5B. Moreover, because the ceiling may define a variable ceiling-to-surface height H1', multiple horizontal spray nozzle devices may define various distances H2' from the surface S of the protection area A. The previously described working pressure range is one preferred range to provide for the desired distribution densities, coverage areas CA and/or vertical height Z. However, it should be understood that the working pressure range can be adjusted accordingly, i.e., expanded or lowered from its maximum or minimum, to effect a desired discharge density and/or geometry to suit the particular application.

The protection area A and its surface S can be divided into multiple zones to provide for zoned protection by the system 10, 1010. More specifically, the system 10, 1010 can be divided into portions and configured to provide selective operation. Thus for example, in the case of a fire event detected in a particular zone, the system 10, 1010 would selectively discharge in the particular zone. To provide for selective discharge, fluid discharge into each zone would be controlled by its own designated fluid control valve 1300. A zone is preferably defined by the width of the surface S or tunnel to be protected and a predetermined length in the direction (bi-direction) of travel through the area A of the tunnel. The size of each zone of protection may range from about 15 meters×25 meters square to about 15 meters×75 meters square. For the preferred protection zone size of 15 meters×50 meters square, it has been determined a hydraulic demand of about 2000 gallons per minute is preferred. Depending upon the configuration (single nozzle, back-to-back), orientation (parallel; perpendicular to main water supply pipe 12) and total coverage area CA defined by a particular horizontal spray nozzle arrangement 100 and its nozzle device(s) 200, each zone can be protected by one or more of the horizontal spray nozzle arrangements 100. Thus, to determine the number of horizontal spray nozzle arrangements 100 for a zone, one would divide the total hydraulic demand of the zone by the total coverage area CA provided by a single horizontal spray nozzle arrangement 100. Referring again to FIG. 5A, the preferred deluge fire protection system 1010 is shown adjacent a prior art or traditional deluge zone system 2020. As can be seen, the preferred system 1010 can be configured with fewer horizontal spray nozzle arrangements 100 as compared to the number of fire protection devices 2200 used in the typical layout.

While the present invention has been disclosed with reference to certain embodiments, numerous modifications, alterations, and changes to the described embodiments are possible without departing from the sphere and scope of the present invention, as defined in the appended claims. Accordingly, it is intended that the present invention not be limited to the described embodiments, but that it has the full scope defined by the language of the following claims, and equivalents thereof.

What is claimed is:

1. A deluge fire protection system for an area having a surface for vehicular transit, comprising:

a main water supply pipe disposed a first distance from the surface; and a horizontal spray nozzle arrangement disposed a second distance from the surface, the second distance being less than the first distance; the horizontal spray nozzle arrangement including:

a nozzle device having a deflector and a frame supporting the deflector, the frame having a body defining an inlet portion, an orifice and a nozzle axis extending from the inlet portion to the orifice along an internal passageway, the inlet portion defining an internal diameter and a cross-sectional area defined by the internal diameter of the inlet portion, the passageway and the orifice defining a nominal K-factor of at least 8.0 GPM/$(PSI)^{1/2}$; and a coupling arrangement between the main water supply and the nozzle device, the coupling arrangement defining at least a two-direction flow path between the main water supply and the nozzle device; the two-direction flow path having an effective length of at least eight times the internal diameter and a cross-sectional area along the coupling arrangement that is greater than the cross-sectional area defined by the internal diameter of the inlet portion;

wherein water discharged from the horizontal spray nozzle arrangement is controlled by a deluge valve coupled to the main water supply pipe, the water being delivered to the spray nozzle arrangement at a working pressure ranging from about 10 psi. to about 30 psi.

2. The deluge fire protection system of claim 1, wherein the area defines a direction of vehicle travel and includes a ceiling disposed above the surface, the main water supply pipe suspended from the ceiling, the main water supply pipe including an outlet, the coupling arrangement including a drop nipple and a pipe fitting coupled to the drop nipple, the drop nipple extending from the outlet toward the surface to define a first direction of the two-direction flow path, the pipe fitting extending from the drop nipple to the frame of the nozzle device to define a second direction of the at least two-direction flow path.

3. The deluge fire protection system of claim 2, wherein the pipe fitting includes an elbow and a reduction assembly.

4. The deluge fire protection system of claim 3, wherein the outlet defines a nominal outlet diameter of 2 inches, the drop nipple has an 8 inch or 9 inch nominal length and defines a nominal diameter of about 2 inches, the elbow a nominal diameter of 2 inches to define an effective length of 8.5 feet, the reduction assembly defining the cross-sectional area between the elbow and the nozzle device being about 1.25 square inches.

5. The deluge fire protection system of claim 2, wherein the pipe fitting includes a tee fitting a first reduction assembly and a second reduction assembly, the horizontal nozzle arrangement including a first horizontal nozzle device coupled to the tee fitting by the first reduction assembly and a second horizontal nozzle device coupled to the tee fitting by a second reduction assembly to define a back-to-back relation between the first and second horizontal nozzle devices.

6. The deluge fire protection system of claim 5, wherein the outlet defines a nominal outlet diameter of 2 inches, the drop nipple has an 8 inch or 9 inch nominal length and defines a nominal diameter of about 2 inches, the tee fitting having a nominal diameter of 2 inches to define an effective length of 12 feet, each of the first and second reduction assemblies defining the cross-sectional area being about 4.5 square inches.

7. The deluge fire protection system of claim 1, wherein the area defines a direction of vehicle travel, the main water supply pipe extending parallel to the direction of vehicle travel and the nozzle axis extending parallel to the main water supply pipe.

8. The deluge fire protection system of claim 1, wherein the area defines a direction of vehicle travel, the main water supply pipe extending parallel to the direction of vehicle travel and the nozzle axis extending perpendicular to the main water supply pipe.

9. The deluge fire protection system of claim 1, wherein the area defines a direction of vehicle travel, the system including a ceiling disposed above the surface and a pair of sidewalls extending from the surface to the ceiling, the main water supply pipe being disposed between the between the pair of sidewalls such that the horizontal spray nozzle arrangement distributes water on one of the pair of walls vertically up to a maximum of 4.5 meters.

10. The deluge fire protection system of claim 9, wherein the main water supply pipe is centered between the between the pair of sidewalls.

11. The deluge fire protection system of claim 1, wherein the area defines a direction of vehicle travel, the system including a ceiling disposed above the surface and a pair of sidewalls extending from the surface to the ceiling, the main water supply pipe including a first main water supply pipe and at least a second water supply pipe each disposed between the pair of sidewalls and extending parallel to the direction of vehicle travel, the horizontal nozzle including a first horizontal spray nozzle arrangement coupled to the first main water supply pipe and at least a second horizontal spray nozzle arrangement coupled to the second main water supply pipe, the coupling arrangement including a first coupling arrangement and at least second coupling arrangement, the first coupling arrangement being between the first main water supply and the first horizontal spray nozzle arrangement, the second coupling arrangement being between the second main water supply and the at least second horizontal spray nozzle arrangement.

12. The deluge fire protection system of claim 11, wherein each of the main water supply pipes include an outlet, each of the first and at least second coupling arrangements including a drop nipple and a pipe fitting coupled to the drop nipple, the drop nipple extending from the outlet toward the surface to define a first direction of the two-direction flow path, the pipe fitting extending from the drop nipple to the horizontal spray nozzle arrangement to define a second direction of the two-direction flow path.

13. The deluge fire protection system of claim 12, wherein the pipe fitting includes an elbow fitting and a reduction assembly, each of the first and at least second horizontal spray arrangements consisting of a single horizontal spray nozzle to direct water to one wall of the pair of sidewalls and away from the other wall of the pair of the sidewalls.

14. The deluge fire protection system of claim 13, wherein at least one of the first and at least second single horizontal spray nozzle is directed perpendicular to the main water supply pipe.

15. The deluge fire protection system of claim 13, wherein the outlet defines a nominal outlet diameter of 2 inches, the drop nipple has an 8 inch or 9 inch nominal length and defines a nominal diameter of about 2 inches, the elbow fitting having a nominal diameter of 2 inches to define an effective length of 8.5 feet, and the reduction assembly defining the cross-sectional area between the elbow and the nozzle device being about 1.25 square inches.

16. The deluge fire protection system of claim 12, wherein the pipe fitting is a tee fitting, each of the first and at least second horizontal spray arrangements including a first horizontal nozzle device coupled to the tee fitting by the first reduction assembly and a second horizontal nozzle device coupled to the tee fitting by a second reduction assembly to define a back-to-back relation between the first and second horizontal nozzle devices.

17. The deluge fire protection system of claim 16, wherein the horizontal nozzle axis of at least one of the first and at least second horizontal spray arrangements is directed perpendicular to the main water supply pipe.

18. The deluge fire protection system of claim 16, wherein each of the first and at least second horizontal spray arrangements is directed perpendicular to the main water supply pipe.

19. The deluge fire protection system of claim 16, wherein the horizontal nozzle axis of at least one of the first and at least second horizontal spray arrangements is directed parallel to the main water supply pipe.

20. The deluge fire protection system of claim 16, wherein the horizontal nozzle axis of each of the first and at least second horizontal spray arrangements is directed parallel to the main water supply pipe.

21. The deluge fire protection system of claim 11, wherein the first and at least second horizontal spray arrangements are disposed at different distances from the surface.

22. The deluge fire protection system of claim 16, wherein the outlet defines a nominal outlet diameter of 2 inches, the drop nipple has an 8 inch or 9 inch nominal length and defines a nominal diameter of about 2 inches, the tee fitting having a nominal diameter of 2 inches to define an effective length of 12 feet, each of the first and second reduction assemblies defining the cross-sectional area being about 4.5 square inches.

23. The deluge fire protection system of claim 1, wherein the horizontal spray nozzle arrangement discharges water to define a first coverage distance in the direction of the horizontal axis, the first coverage distance ranging from about 20 feet to about 25 feet.

24. The deluge fire protection system of claim 23, wherein the first coverage distance ranges from 19 feet-7 inches to about 24 feet-7 inches.

25. The deluge fire protection system of claim 1, wherein the horizontal arrangement discharges water to define a second coverage distance in a direction lateral of the horizontal axis, the second coverage distance being about 8 feet.

26. The deluge fire protection system of claim 25, the second coverage distance being 8 feet-two inches.

27. The deluge fire protection system of claim 1, wherein the horizontal spray nozzle arrangement defines a minimum distance from the surface of about 18 feet.

28. The deluge fire protection system of claim 1, wherein the frame of the nozzle device include a pair of frame arms disposed about the outlet to define a plane, the nozzle axis disposed in the plane, the deflector including a face plate portion centered and disposed orthogonal to the nozzle axis and a canopy portion having a leading edge, the face plate being axially disposed between the leading edge and the body, the leading edge being radially spaced from the nozzle axis and extending substantially parallel to the plane.

29. The deluge fire protection system of claim 28, wherein the deflector includes a plurality of tines extending radially from the face plate, the tines being disposed to one side of the plane opposite the canopy portion.

30. The deluge fire protection system of claim 29, wherein each of the plurality of tines includes a peripheral edge aligned along a perimeter of a common circle centered on the nozzle axis.

31. The deluge fire protection system of claim 1, wherein the nominal K-factor comprises one of: 16.8 GPM/$(PSI)^{1/2}$; 19.6 GPM/$(PSI)^{1/2}$; 22.4 GPM/$(PSI)^{1/2}$; and 25.2 GPM/$(PSI)^{1/2}$.

* * * * *